US007857918B2

(12) United States Patent
Ishikawa et al.

(10) Patent No.: US 7,857,918 B2
(45) Date of Patent: Dec. 28, 2010

(54) METHOD OF PRODUCTION OF STEEL PRODUCT WITH NANOCRYSTALLIZED SURFACE LAYER

(75) Inventors: Tadashi Ishikawa, Futtsu (JP); Kiyotaka Nakashima, Futtsu (JP); Tetsuro Nose, Futtsu (JP); Tomonori Tominaga, Futtsu (JP); Yakichi Higo, Yokohama (JP); Kazuki Takashima, Yokohama (JP)

(73) Assignee: Nippon Steel Corporation, Tokyo (JP)

( * ) Notice: Subject to any disclaimer, the term of this patent is extended or adjusted under 35 U.S.C. 154(b) by 332 days.

(21) Appl. No.: 10/535,346

(22) PCT Filed: Nov. 17, 2003

(86) PCT No.: PCT/JP03/14595

§ 371 (c)(1),
(2), (4) Date: Oct. 3, 2005

(87) PCT Pub. No.: WO2004/046394

PCT Pub. Date: Jun. 3, 2004

(65) Prior Publication Data

US 2006/0130942 A1 Jun. 22, 2006

(30) Foreign Application Priority Data

Nov. 19, 2002 (JP) ..... 2002-334501

(51) Int. Cl.
*C21D 7/06* (2006.01)
*C21D 10/00* (2006.01)

(52) U.S. Cl. ..... 148/558; 29/81.14

(58) Field of Classification Search ..... 148/558, 148/561, 565; 29/81.13, 81.14, 81.15; 72/53; 173/133

See application file for complete search history.

(56) References Cited

U.S. PATENT DOCUMENTS

| | | | | |
|---|---|---|---|---|
| 6,171,415 | B1 | 1/2001 | Statnikov | |
| 6,338,765 | B1 * | 1/2002 | Statnikov | 148/558 |

FOREIGN PATENT DOCUMENTS

| | | |
|---|---|---|
| JP | 58-116954 | 7/1983 |
| JP | 64-79320 | 3/1989 |
| JP | 1-110707 | 4/1989 |
| JP | 1944370 | 6/1995 |
| JP | 8-1514 | 1/1996 |

(Continued)

OTHER PUBLICATIONS

K. Lu, Nanocrystalline metals crystallized from amorphous solids: nanocrystallization, structure, and properties, Materials Science and Engineering, R16 (1996) p. 161-221.*

(Continued)

*Primary Examiner*—George Wyszomierski
*Assistant Examiner*—Mark L Shevin
(74) *Attorney, Agent, or Firm*—Kenyon & Kenyon LLP

(57) ABSTRACT

A method of production of a metallic product with a nanocrystallized surface layer comprising subjecting a surface layer of a metallic product to ultrasonic impact treatment by one or more ultrasonic indenters vibrating in a plurality of directions, then subjecting the surface layer subjected to the ultrasonic impact treatment to heat treatment at a low temperature to cause precipitation of nanocrystals.

17 Claims, 2 Drawing Sheets

FOREIGN PATENT DOCUMENTS

| | | |
|---|---|---|
| JP | 09-234585 | 9/1997 |
| JP | 2002-220647 | 8/2002 |
| JP | 2003-113418 | 4/2003 |
| JP | 2003-201549 | 7/2003 |
| WO | WO 02/10462 A1 | 2/2002 |

OTHER PUBLICATIONS

W Toman et al, Protective Gases, in Ullmann's Encyclopedia of Industrial Chemistry, Wiley-VCH Verlag GmbH & Co, online Jun. 15, 2000. p. 1-14 (15 pages including front matter).*

G. Liu et al. Surface nanocrystallization of 316L stainless steel induced by ultrasonic shot peening. Materials Science and Engineering A286 (2000) p. 91-95.*

X.Y. Wang and D.Y. Li, Mechanical and electrochemical behavior of nanocrystalline surface of 304 stainless steel, Electrochimica Acta, 47, (2002), p. 3939-3947.*

Tao N.R. et al: "Surface Nanocrystallization of Iron Induced by Ultrasonic Shot Peening", Jun. 4, 1999, Nanostructured Materials, vol. 11, No. 4, pp. 433-140.

International Search Report dated Feb. 24, 2004 issued in corresponding PCT Application No. PCT/JP03/14595.

Kazuya Yamada et al. "Cho Onpa Shot Peening ni yoru Zairyo Hyomenso no Nano-Kesshoka" The Japan Institute of Metals Koen Gaiyo, Nov. 2, 2002, vol. 131, p. 265 [with English Translation].

* cited by examiner

METHOD OF PRODUCTION OF STEEL PRODUCT WITH NANOCRYSTALLIZED SURFACE LAYER

TECHNICAL FIELD

The present invention relates to a method of production of a metallic product with a nanocrystallized surface layer.

BACKGROUND ART

Metallic products are superior in strength and cost compared with other materials, so are being used in a variety of fields such as offshore structures, ships, bridges, automobiles, industrial machinery, household electrical appliances, medical equipment, etc. Therefore, metallic products play important roles in industry.

However, the ultrahigh strength, fatigue resistance, wear resistance, and other characteristics required for metallic products are important characteristics not for the metallic products as a bulk, but in particular for the surface layers of the metallic products. In many cases, there is no need for the products as a bulk to have such characteristics.

Therefore, broad use is being made of the method of controlling the crystal structure of the surface layer of a metallic material so as to impart various superior properties to the material. Up to now, a succession of superior materials have been created with the introduction of each new process for the control of the crystal structure. In the future as well, there is a possibility of much more superior materials being created due to the introduction of new processes.

In recent years, it has become possible to refine the crystal structures of metallic materials to a nanometer (nm, $10^{-9}$ m) level size (for example refined to less than 100 nm), i.e., to achieve a nanocrystal structure, so as to obtain superior properties not achievable in the past, for example, ultrahigh strength.

As a method of obtaining a metallic material having a nanocrystal structure, there is known the method of once amorphize the metallic material and then converting it from a amorphous state to a crystalline state so as to obtain a nanocrystal structure.

As a method of amorphizing a metallic material, the method of high speed rapid cooling of the melt of the metallic material, sputter deposition, or other methods may be used.

If making the atomic configuration of a metallic material amorphous, unique properties not obtainable by a crystallined metal are obtained and a metallic material having high strength, corrosion resistance, high magnetic permeability, and other superior properties can be obtained.

By heat treating such an amorphous metallic material at a low temperature, it is possible to make fine nanometer (nm, $10^{-9}$ m) size crystals, that is, nanocrystals, precipitate. Further, it is possible to obtain a metallic material exhibiting properties more superior to an amorphous metal, for example, a metallic material exhibiting ultrahigh strength or a metallic material superior in magnetic characteristics (for example, see Japanese Unexamined Patent Publication (Kokai) No. 1-110707 or Japanese Patent No. 1944370).

The method of amorphizing a metallic material and then heat treating it at a low temperature to cause nanocrystals to precipitate in this way should be taken note of as a method for imparting superior properties and functions not achievable with conventional methods to a metallic material.

However, in providing metallic materials using this method for actual use, there have been the problems explained below.

First, as methods for obtaining metallic materials in the amorphous state, there are the method of high speed rapid cooling of the melt of the metallic material and the method of sputter deposition, but these methods involve high speed rapid cooling or deposition, so there are major restrictions on the shape or dimensions, and application to the production of shaped articles, structures, and metallic products of general shapes has been difficult.

Further, as the method of amorphizing a metallic material and causing nanocrystals to precipitate, in addition to the above-mentioned methods, the following method is known.

That is, it is possible to treat a powder of a metallic material by a ball mill etc., then work-harden the surface of the material to amorphize the material, then heat treat the material to obtain a metallic material with nanocrystals precipitated.

The thus produced metal powder may be used not only as an alloy powder of an amorphous metal as it is, but may also be press formed and used as shaped articles, structures, and metallic products of general shapes.

It becomes necessary to press form this powder at a high temperature to obtain a shaped article having sufficient strength for this purpose or weld such shaped articles to fabricate a desired structure.

However, if an alloy powder of an amorphous metal experiences a high temperature process, the powder will lose its nanocrystal structure and change to a large crystal structure. Therefore, it was not possible to obtain a shaped article, structure, or metallic product making use of the features of a nanocrystalline structure from a metal powder with nanocrystals precipitated.

Note that for example the specification of U.S. Pat. No. 6,171,415 discloses a method of modification of the fatigue strength by applying ultrasonic vibration to a welded joint zone, but does not disclose applying ultrasonic vibration to the surface layer of a metallic product to make it nanocrystalline.

SUMMARY OF INVENTION

The present invention has as its object to solve the above-mentioned problems of the prior art and provide a method of production of a metallic product with a nanocrystallized surface layer.

The present invention was made as a result of intensive study for solving the above problems and provides a method of production of a metallic product with a nanocrystallized surface layer made nanocrystalline by subjecting the surface layer of the metallic product to ultrasonic impact treatment for impacting by an ultrasonic indenter so as to work-harden the surface layer, then heat treating this at a low temperature.

Further, the gist is as follows:

(1) A method of production of a metallic product with a nanocrystallized surface layer, the method of production of a metallic product with a nanocrystallized surface layer characterized by comprising (1) subjecting a surface layer of a metallic product to ultrasonic impact treatment impacting it by one or more ultrasonic indenters vibrating in a plurality of directions, then (2) subjecting the surface layer subjected to the ultrasonic impact treatment to heat treatment at a low temperature to cause precipitation of nanocrystals.

In the present invention, the "metallic product" includes not only bridges, buildings, and other so-called steel structures, but also the metallic parts, steel plates, aluminum products, titanium products, and other common products made of metal.

Further, the "nanocrystal" means fine crystals of a nanometer size, that is, a $10^{-9}$ m size. The range of the grain size is, from the properties shown, an average grain size of 1 to 100 nm, more preferably 3 to 30 nm.

(2) A method of production of a metallic product with a nanocrystallized surface layer as set forth in (1), characterized in that the surface layer of the metallic product subjected to the ultrasonic impact treatment is in an amorphous state.

(3) A method of production of a metallic product with a nanocrystallized surface layer as set forth in (1) or (2), characterized in that the ultrasonic impact treatment is accompanied with mechanical alloying.

(4) A method of production of a metallic product with a nanocrystallized surface layer as set forth in any one of (1) to (3), characterized by making an amorphous phase and a nanocrystal phase copresent in precipitation of the nanocrystals.

(5) A method of production of a metallic product with a nanocrystallized surface layer as set forth in any one of (1) to (4), characterized by shielding the surroundings at the time of the ultrasonic impact treatment from the air.

(6) A method of production of a metallic product with a nanocrystallized surface layer as set forth in any one of (1) to (5), characterized in that the surface layer of the metallic product is comprised of a ferrous metal and the surface layer is subjected to heat treatment for heating at 100 to 500° C. for 15 minutes or more.

THE MOST PREFERRED EMBODIMENT

The embodiments of the present invention will be explained in detail using FIG. 1 to FIG. 4.

<First Embodiment>

Figure 1:
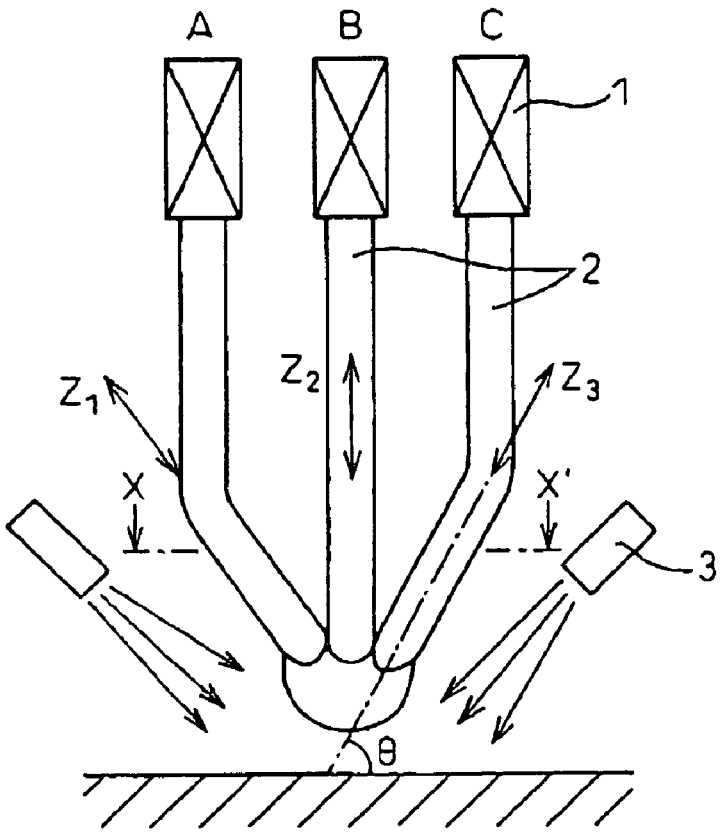
FIG. 1 is a view of a first embodiment of the present invention.

In FIG. 1, 1 indicates an ultrasonic vibration apparatus, 2 ultrasonic indenters, and 3 a shield gas feed apparatus.

First, as shown in FIG. 1, the surface layer of a metallic product is impacted by the ultrasonic indenters 2.

In the present embodiment, a plurality of (three) ultrasonic indenters 2 is provided. The tips of the indenters are made to vibrate in different directions (in the figure, $Z_1$, $Z_2$, and $Z_3$).

The reason for impacting the surface layer of the metallic product by one or more ultrasonic indenters vibrating in a plurality of directions is as follows:

In working by impacting making ultrasonic indenters vibrate in only one direction, the structure of the surface layer of the metallic product is developed, the crystal grains do not become equiaxial, and the crystal grains deform to pancake shapes. High angle grain boundaries are not formed.

Therefore, by using a plurality of ultrasonic indenters, making the tips of the ultrasonic indenters vibrate in a plurality of different directions, and impacting the surface layer of the metallic product, formation of texture is suppressed and the grains become equiaxial.

Further, by heat treating at a low temperature the surface layer of the metallic product subjected to the ultrasonic impact treatment, it is possible to make the surface layer nanocrystalline.

This ultrasonic impact treatment work-hardens the surface layer of the metallic product in a range of for example a surface layer of 100 μm so as to sufficiently disarrange the crystal lattice and cause the loss of the properties as crystals and for example form a state of atomic configuration disarranged to an extent not allowing movement of dislocations at the surface layer.

Further, to facilitate nanocrystallization, it is preferable to use ultrasonic impact treatment to make the surface layer of the metallic product, for example, the range of a 100 μm surface layer, an amorphous state with no long period atomic configuration.

The ultrasonic impact treatment is performed cold. If performing it not cold, but at the recrystallization temperature or a higher temperature, the work-hardening causes the recrystallization of the layer with a disarranged crystal lattice to proceed rapidly resulting in crystals of a large grain size and difficulty in obtaining a nanocrystal structure.

Therefore, the temperature of the ultrasonic impact treatment has to be made a temperature sufficiently lower than the recrystallization temperature of the metallic material.

The ultrasonic impact treatment is accompanied with the heat of working generated, so when necessary the surface layer of the metallic product is cooled so that the temperature of the surface layer is brought closer to the recrystallization temperature.

In the present invention, the angles of the plurality of vibration directions are not limited, but the impact is applied from as different directions as possible. Therefore, as shown in FIG. 1, it is preferable to make the incident angle (θ) with respect to the surface layer of the metallic product 30 degrees or more.

After the ultrasonic impact treatment, the surface layer is heat treated at a low temperature to cause precipitation of nanocrystals. This heat treatment is performed at a low temperature at which the crystal grains will not coarsen.

As the heat treatment temperature, a temperature higher than the ambient temperature at which the metallic product is used is selected. If using a Cooper heater etc. for heat treatment over a sufficient time, it is possible to obtain stable nanocrystals at the surface layer of the metallic product.

In the present invention, the size of the crystal grains forming the nanocrystal structure can be suitably selected in accordance with the composition of the metallic material or the object, but in average diameter is 1 to 100 nm, more preferably 3 to 30 nm.

The shield gas feed apparatus 3 blows argon, helium, $CO_2$, or another inert gas to the tips of the ultrasonic indenters to shield the surroundings at the time of the ultrasonic impact treatment from the air. The action and effect of this will be explained later.

Note that the heat treatment when the metallic product is comprised of a ferrous material is preferably performed suitably selecting the surface temperature in the range of 100 to 500° C. and the treatment time in the range of 15 minutes or more considering the ease of recrystallization of ferrous materials.

Figure 2:
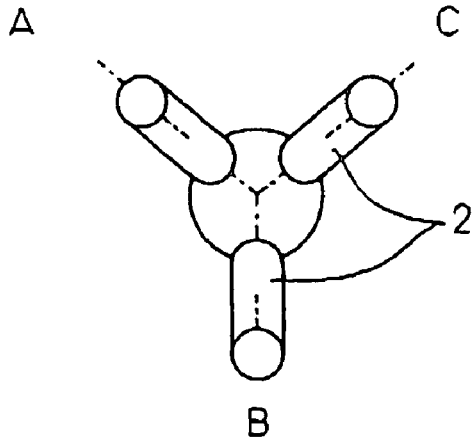
FIG. 2 is a plan view seen along the line X-X' of FIG. 1.

FIG. 2 is a plan view seen along line X-X' in FIG. 1 showing a first embodiment.

In FIG. 2, the ultrasonic indenters 2 are arranged at angles of 120 degrees from each other and are structured so that the tips of the ultrasonic indenters are made to vibrate in different directions.

Figure 3:
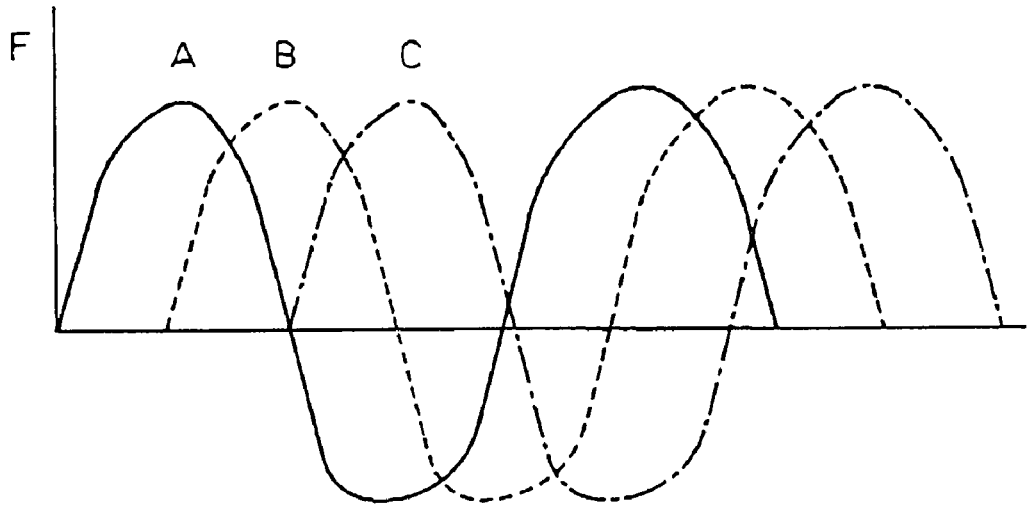
FIG. 3 is a view illustrating vibration waveforms of indenters of A, B, and C shown in FIG. 1.

FIG. 3 is a view of the vibration waveforms of the indenters of A, B, and C shown in FIG. 1.

In FIG. 3, the vibration waveforms (F) of A, B, and C are offset by ⅓ a period each to make the tips of the vibration indenters 2 vibrate in successively different directions, so the structure of the surface layer of the metallic product can be efficiently made nanocrystalline.

<Second Embodiment>

Figure 4:
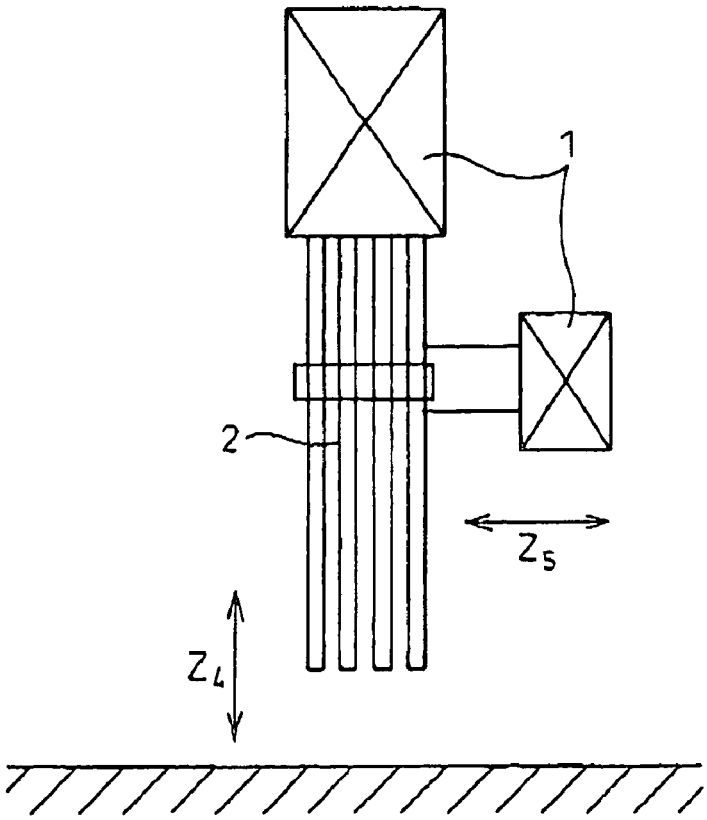
FIG. 4 is a view of a second embodiment of the present invention.

In FIG. 4, 1 indicates ultrasonic vibration apparatuses and 2 ultrasonic indenters.

In the present embodiment, a plurality of ultrasonic indenters 2 are used bundled together. The bundled ultrasonic indenters 2 as a bulk are simultaneously made to vibrate in the vertical direction ($Z_4$) and the horizontal direction ($Z_5$). Therefore, a plurality of ultrasonic vibration apparatuses 1 are provided.

By making the ultrasonic indenters 2 vibrate simultaneously in the vertical direction and horizontal direction and impact the surface layer of the metallic product, it is possible to suppress the formation of texture and make the crystal grains equiaxial.

Further, after this, it is possible to heat treat the surface layer of the metallic product at a low temperature to cause the precipitation of nanocrystals and make the surface layer nanocrystalline.

Note that even if using a single ultrasonic indenter 2 and making it vibrate in the vertical direction or even if making the ultrasonic indenters turn or rock instead of vibrating in the horizontal direction, it is possible to obtain similar effects.

<Embodiments Common to First Embodiment and Second Embodiment>

The inventors discovered that if nitrogen enters at the time of subjecting the surface layer of the metallic product to ultrasonic impact treatment, a Cottrell atmosphere is formed and the strength rises, but the toughness sometimes falls, so this is not preferable.

Further, the inventors discovered that if performing the ultrasonic impact treatment in the air, the metal of the surface layer of the metallic product reacts with the oxygen in the air whereby an oxide layer ends up being formed and that even with nanocrystallization, the predetermined functions cannot be obtained in some cases. That is, the inventors discovered that the minimization of the oxide layer is essential.

Therefore, to secure the thickness of the nanocrystallized layer and suppress the thickness of the oxide layer to a minimum, it is preferable to shield the surroundings at the time of ultrasonic impact treatment from the air. That is, by shielding from the oxygen, the oxidation of the surface is prevented.

In the present invention, the method of shielding the surroundings is not limited, but it is preferable to blow argon, helium, $CO_2$, or another inert gas at the tips of the ultrasonic indenters so as to control the environment to an oxygen partial pressure lower than that of air.

Due to this, the oxide layer is eliminated and the phenomenon of embrittlement due to nitrogen penetration can be prevented.

In the precipitation of the nanocrystals, it is possible to cause precipitation of nanocrystals without leaving any work-hardened phase or possible to cause copresence of the work-hardened phase, for example, the amorphous phase, and the nanocrystal phase. By causing the copresence of the amorphous phase and nanocrystal phase, it is possible to increase the strength of the material or maintain a high corrosion resistance.

In this case, to obtain the effect of the nanocrystal structure, it is preferable to make the ratio by volume of the crystal phase to the amorphous phase at least 15 to 85. Further, to obtain the effect of copresence of the crystal phase and amorphous phase explained above, it is preferable to make the ratio of volume of the crystal phase to the amorphous phase not more than 80 to 20.

In the present invention, the ultrasonic impact treatment may be accompanied with mechanical alloying.

For example, it is possible to have the ultrasonic indenters and the surface layer of the metallic product plastically deform with each other to cause mechanical alloying between them.

By properly selecting the composition of the material of the ultrasonic indenters and making the surface layer of the metallic product in the amorphous state obtained along with mechanical alloying a nanocrystal structure, it is possible to obtain a nanocrystal structure of a desired alloy composition or give a desired composition to the vicinity of the nanocrystals.

In this way, by amorphizing the surface layer of the metallic product and simultaneously causing mechanical alloying in ultrasonic impact treatment, it is possible to obtain a nanocrystallized metallic product having more superior characteristics.

According to the present invention, it is possible to finally work or assemble the steel structure, steel product, or other metallic product, then make the surface layer nanocrystalline, so it is possible to keep application of the present invention to the minimum necessary extent.

Further, it is possible to apply the present invention at the material stage, finally work or assemble the steel structure, steel product, or other metallic product, then repair a region damaged by the working or assembly by again applying the present invention to just that region.

Note that the present invention may be locally applied to a region of the metallic product for which modification by nanocrystallization is desired or may be applied to the metallic product as a whole.

When applying the present invention to the metallic product as a bulk, it is preferable to subject the steel plate or other material forming the metallic product to the ultrasonic impact treatment of the present invention in advance and produce the metallic product using a material with a nanocrystallized surface layer.

The ultrasonic wave generation apparatus used for the present invention is not particularly limited in type, but an apparatus which uses a 2 W to 3 kW ultrasonic wave generation source, uses a transducer to generated a 2 kHz to 60 kHz ultrasonic vibration, and uses a waveguide to amplify it and cause ultrasonic indenters provided with one or more of 1 mm to 5 mm diameter pins to vibrate by an amplitude of 20 to 60 μm is preferable.

However, the tips of the ultrasonic indenters in the first embodiment receive vibration from a plurality of ultrasonic indenters, so are preferably round with diameters of at least 10 mm.

Above, by using the present invention, it is possible to obtain a metallic product with a surface part given an ultra-high strength and excellent toughness.

An experiment was conducted envisioning application of the present invention to actual metallic products. The results are shown in Table 1 to Table 4.

Table 1 shows the chemical compositions (mass %) and thicknesses (mm) of the materials A (A1 to A13) forming metallic parts.

Table 2 shows the ultrasonic impact treatment conditions and heat treatment conditions, while Table 3 (continuation of Table 2) shows the test results.

* 1). <Type of Working>

The type of working, as shown in Table 4, is use of round-tip pins as ultrasonic indenters.

* 2) <Thickness of Modified Layer>

The thickness of the modified layer shows the thickness from the surface of the layer where the microstructure of the metallic product changes to become amorphous or finer in crystal grains.

* 3) <Nanocrystallization Ratio (%)>

The nanocrystallization ratio shows the area ratio (%) of the region in the modified layer where the crystal grain size can be determined with an electron microscope to be less than 1 μm.

<Amorphous Ratio (%)>

The amorphous ratio shows the area ratio (%) of the region in the modified layer where crystal grains cannot be observed with an electron microscope.

* 4) <Hardness Ratio Before/After Modification of Surface Layer>

The hardness ratio before/after modification of the surface layer shows the ratio of the hardness of the surface layer of the metallic part after application of the present invention to the hardness before application of the present invention.

* 5) <Results of Fatigue Test by Micro Test Piece>

The region including the layer modified by ultrasonic impact treatment was observed by a scanning electron microscope and a test piece was cut out from that region by ion sputtering.

A micro test piece of a thickness of 20 μm, a width of 100 μm, and a length of 800 μm was used for a fatigue test by a microtester system so as to find an S—N diagram.

Further, the fatigue strength indicating fracture at 1,000,000 cycles was evaluated by the ratio of modification of the fatigue strength before/after modification as defined by the following equation:

Ratio of modification of fatigue strength before/after modification=(Fatigue strength of 1,000,000 cycles at modified layer)/(Fatigue strength of 1,000,000 cycles at test piece taken from unmodified region)

* 6) <Results of Evaluation of Corrosion Loss by Micro Test Piece>

The region including the layer modified by ultrasonic impact treatment was observed by a scanning electron microscope and a test piece was cut out from that region by ion sputtering.

A micro test piece of a thickness of 20 μm, a width of 100 μm, and a length of 800 μm was used for a salt water spray corrosion test. The results of the corrosion test are affected by the corrosion conditions and the corrosion sensitivity of the material, so an unambiguous interpretation of the results is extremely difficult.

Therefore, a micro test piece taken from an unmodified region and a micro test piece taken from the modified layer were simultaneously subjected to a corrosion test under the same conditions and the change in the weight loss due to corrosion over time was measured.

When the corrosion loss of the test piece taken from the region not the modified layer became 30%, the corrosion loss of the test piece taken from the modified layer was measured and the ratio was evaluated by the ratio of modification of the corrosion loss before/after modification defined by the following equation:

Ratio of modification of corrosion loss before/after modification=(Corrosion loss at modified surface)/(Corrosion loss at test piece taken from non-modified region)

No. 1 to No. 18 are examples of the invention satisfying the conditions of the present invention. According to these examples of the invention, it was confirmed that by applying the present invention to a steel structure, steel part, steel plate, aluminum product, titanium product, or other metallic product, it is possible to remarkably improve the wear resistance, fatigue resistance, and corrosion resistance.

TABLE 1

| No. of Material | | Matrix | Chemical composition (mass %) | | | | | | |
|---|---|---|---|---|---|---|---|---|---|
| A | Material | component | C | Si | Mn | P | S | Al | Ti |
| A1 | Steel | Fe | 0.10 | 0.26 | 1.18 | 0.006 | 0.003 | 0.026 | 0.009 |
| A2 | Steel | Fe | 0.08 | 0.21 | 1.46 | 0.008 | 0.003 | 0.021 | 0.010 |
| A3 | Steel | Fe | 0.06 | 0.27 | 1.38 | 0.006 | 0.004 | 0.011 | 0.008 |
| A4 | Steel | Fe | 0.04 | 0.18 | 1.44 | 0.009 | 0.005 | 0.022 | 0.015 |
| A5 | Steel | Fe | 0.07 | 0.25 | 1.30 | 0.007 | 0.003 | 0.015 | 0.014 |
| A6 | Steel | Fe | 0.04 | 0.11 | 0.92 | 0.009 | 0.005 | 0.022 | 0.015 |
| A7 | Steel (wear resistant steel) | Fe | 0.27 | 0.25 | 1.41 | 0.006 | 0.003 | 0.029 | |
| A8 | Steel (stainless steel) | Fe | 0.06 | 0.80 | 0.18 | 0.002 | 0.002 | | |
| A9 | Steel (heat resistant steel) | Fe | 0.09 | 0.24 | 0.55 | 0.005 | 0.003 | 0.075 | |
| A10 | Aluminum alloy | Al | | 0.30 | 0.61 | | | Bal. | |
| A11 | Titanium alloy | Ti | | | 2.20 | | | 2.100 | Bal. |
| A12 | Magnesium alloy | Mg | | | 0.12 | | | 2.900 | |

TABLE 1-continued

| | | | | | | | | | |
|---|---|---|---|---|---|---|---|---|---|
| A13 | Ni super alloy | Ni | | 0.05 | 0.40 | 0.50 | | 0.750 | |

| No. of Material | Chemical composition (mass %) | | | | | | | | Thickness t |
|---|---|---|---|---|---|---|---|---|---|
| A | Ni | Cu | Mg | Mo | Cr | Nb | V | B | (mm) |
| A1 | | | 0 | | | 0.02 | 0.12 | | 25 |
| A2 | | | 0.0004 | | | 0.02 | | 0.0016 | 60 |
| A3 | 0.41 | 0.40 | 0 | | | 0.004 | 0.05 | | 70 |
| A4 | 0.14 | 0.15 | 0.0002 | 0.3 | 0.2 | 0.01 | 0.2 | | 70 |
| A5 | | | 0.0017 | | | 0.02 | 0.1 | | 40 |
| A6 | 1.50 | | 0.0002 | 0.3 | 0.2 | 0.01 | 0.2 | | 70 |
| A7 | | | | | 0.52 | | | 0.0012 | 30 |
| A8 | 10.00 | | | | 19 | | | | 20 |
| A9 | 10.20 | | | 1 | 9.02 | 0.07 | 0.2 | | 20 |
| A10 | | 0.55 | 1.6000 | | 0.05 | | | Zn: 0.2 | 20 |
| A11 | | | | | | | | | 15 |
| A12 | 0.10 | 0.01 | Bal. | | | | | Zn: 1.1 | 35 |
| A13 | Bal. | 0.05 | | | 15 | 0.9 | | Fe: 7.0 | 20 |

TABLE 2

| | | | Ultrasonic impact treatment | | | | | | Heat treatment after working | |
|---|---|---|---|---|---|---|---|---|---|---|
| Inv. ex. no. | Application | Material A | Type of working | Atmosphere | Output (W) | Frequency (kHz) | Treatment time (min) | Temp. during treatment at surface layer (° C.) | Heat treatment temp. (° C.) | Treatment time (min) |
| 1 | Steel structures | A1 | H(1) | $CO_2$ gas | 1000 | 40 | 3 | 50 | 200 | 600 |
| 2 | Steel structures | A1 | H(1) | Air | 500 | 60 | 3 | 45 | 240 | 20 |
| 3 | Steel plate | A2 | H(1) | $CO_2$ gas | 200 | 20 | 10 | 90 | 450 | 30 |
| 4 | Steel structures | A2 | H(2) | Argon gas | 1000 | 10 | 2 | 120 | 200 | 70 |
| 5 | Steel structures | A3 | H(2) | Argon gas | 1000 | 2 | 1 | 200 | 100 | 20 |
| 6 | Parts | A4 | H(2) | Argon gas | 500 | 40 | 3 | 90 | 300 | 14 |
| 7 | Parts | A5 | H(2) | Helium gas | 2 | 60 | 20 | 90 | 500 | 5 |
| 8 | Steel plate | A6 | H(2) | Air | 200 | 20 | 2 | 70 | 230 | 35 |
| 9 | Aluminum products | A7 | H(2) | $CO_2$ gas | 1000 | 10 | 4 | 40 | 150 | 70 |
| 10 | Titanium products | A8 | H(1) | Argon gas | 500 | 2 | 5 | 35 | 300 | 50 |
| 11 | Mg products | A12 | H(3) | Argon gas | 200 | 60 | 2 | 200 | 100 | 40 |
| 12 | Ni products | A13 | H(3) | Helium gas | 2 | 20 | 30 | 40 | 350 | 5 |
| 13 | Steel structures | A1 | H(1) | Argon gas | 1000 | 40 | 3 | 130 | 100 | 40 |
| 14 | Steel structures | A1 | H(1) | Argon gas | 500 | 60 | 3 | 45 | 400 | 8 |
| 15 | Steel plate | A2 | H(1) | Helium gas | 200 | 20 | 10 | 90 | 500 | 3 |
| 16 | Steel structures | A2 | H(1) | Helium gas | 1000 | 10 | 2 | 200 | 550 | 35 |
| 17 | Steel structures | A3 | H(1) | Helium gas | 1000 | 2 | 1 | 150 | 450 | 70 |
| 18 | Parts | A4 | H(1) | Helium gas | 500 | 40 | 3 | 300 | 100 | 20 |

TABLE 3

| | Properties after working | | | | | | |
|---|---|---|---|---|---|---|---|
| Inv. ex. no. | Thickness of modified layer (μm) | Nanocrystallization ratio (%) (*3) | Amorphous ratio (%) (*3) | Hardness ratio before/after modification of surface layer (*4) | Results of fatigue test by micro test piece (*5) | Results of evaluation of corrosion loss by micro test piece (*6) | Characteristics of surface layer (expected function) |
| 1 | 1200 | 85 | 15 | 3.6 | 3.158 | 1.00 | Wear resistance, fatigue resistance |
| 2 | 450 | 75 | 25 | 3.2 | 2.76 | 0.71 | Corrosion resistance, fatigue resistance |
| 3 | 200 | 65 | 35 | 2.6 | 2.373 | 0.56 | Corrosion resistance, fatigue resistance |
| 4 | 3400 | 20 | 80 | 1 | 0.78 | 0.28 | Corrosion resistance |
| 5 | 2100 | 15 | 85 | 0.8 | 0.618 | 0.26 | Corrosion resistance |
| 6 | 700 | 85 | 15 | 3.6 | 3.158 | 1.00 | Wear resistance, fatigue resistance |
| 7 | 32 | 90 | 10 | 3.8 | 3.363 | 1.00 | Wear resistance, fatigue resistance |
| 8 | 200 | 25 | 75 | 1.2 | 0.945 | 0.29 | Corrosion resistance |

TABLE 3-continued

| Inv. ex. no. | Properties after working: Thickness of modified layer (μm) | Nanocrystal-lization ratio (%) (*3) | Amorphous ratio (%) (*3) | Hardness ratio before/after modification of surface layer (*4) | Results of fatigue test by micro test piece (*5) | Results of evaluation of corrosion loss by micro test piece (*6) | Characteristics of surface layer (expected function) |
|---|---|---|---|---|---|---|---|
| 9 | 3200 | 75 | 25 | 3.2 | 2.76 | 0.71 | Wear resistance, fatigue resistance |
| 10 | 1200 | 80 | 20 | 3.4 | 2.958 | 0.83 | Wear resistance, fatigue resistance |
| 11 | 300 | 80 | 20 | 3.4 | 2.958 | 0.83 | Wear resistance, fatigue resistance |
| 12 | 25 | 75 | 25 | 3.2 | 2.76 | 0.71 | Wear resistance, fatigue resistance |
| 13 | 2500 | 80 | 20 | 3.4 | 2.958 | 0.83 | Wear resistance, fatigue resistance |
| 14 | 25 | 80 | 20 | 3.4 | 2.958 | 0.83 | Wear resistance, fatigue resistance |
| 15 | 1200 | 75 | 25 | 3.2 | 2.76 | 0.71 | Wear resistance, fatigue resistance |
| 16 | 210 | 25 | 75 | 1.2 | 0.945 | 0.29 | Corrosion resistance |
| 17 | 1300 | 70 | 30 | 3 | 2.585 | 0.63 | Wear resistance, fatigue resistance |
| 18 | 700 | 20 | 80 | 1 | 0.78 | 0.28 | Corrosion resistance |

TABLE 4

| Type | Indenter tip | Shape of tip | Type of multiaxis working |
|---|---|---|---|
| H(1) | Pin | Round | FIG. 1, 2 type |
| H(2) | Pin | Round | FIG. 4 type |
| H(3) | Pin | Round | Rotating pin |

INDUSTRIAL APPLICABILITY

According to the present invention, it is possible to provide a metallic product with a nanocrystallized surface layer. Therefore, the present invention provides an industrially useful metallic product.

The invention claimed is:

1. A method of production of a steel product with a nanocrystallized surface layer, said method comprising the steps of:

(1) subjecting a surface layer of a steel product to ultrasonic impact treatment by impacting it at a plurality of different directions and angles using one or more ultrasonic indenters, wherein said one or more indenters comprise three indenters joined at their tips such that the tips of the ultrasonic indenters vibrate in a plurality of different directions, with said ultrasonic impact treatment of said surface layer providing equiaxial grains in said surface layer, then, (2) subjecting the surface subjected to the ultrasonic impact treatment to heat treatment at 100° to 500° C. for 15 minutes or more to cause precipitation of nanocrystals.

2. A method of production of a steel product with a nanocrystallized surface layer as set forth in claim 1, characterized in that said ultrasonic impact treatment produces an amorphous state in said surface layer.

3. A method of production of a steel product with a nanocrystallized surface layer as set forth in claim 1, characterized in that said ultrasonic impact treatment is accompanied with mechanical alloying.

4. A method of production of a steel product with a nanocrystallized surface layer as set forth in claim 1, characterized by making an amorphous phase and a nanocrystal phase copresent in precipitation of said nanocrystals.

5. A method of production of a steel product with a nanocrystallized surface layer as set forth in claim 1, characterized by shielding the surroundings at the time of said ultrasonic impact treatment from the air.

6. A method of production of a steel product with a nanocrystallized surface layer as set forth in claim 1, wherein at least one of the indenters is arranged to provide an incident angle with respect to the surface layer of the steel product of 30 degrees or more.

7. A method of production of a steel product with a nanocrystallized surface layer as set forth in claim 1, wherein the three indenters are arranged at 120 degrees from each other.

8. A method of production of a steel product with a nanocrystallized surface layer as set forth in claim 6, wherein vibration waveforms of the indenters are offset by ⅓ period from each other.

9. A method of production of a steel product with a nanocrystallized surface layer as set forth in claim 1, wherein said ultrasonic impact treatment is by impacting said surface at a plurality of different directions using one indenter made to turn or rock.

10. A method of production of a steel product with a nanocrystallized surface layer as set forth in claim 1, wherein a temperature of the ultrasonic impact treatment is made to be a temperature lower than the recrystallization temperature of the steel.

11. A method of production of a steel product with a nanocrystallized surface layer, said method comprising the steps of:

(1) subjecting a surface layer of a steel product to ultrasonic impact treatment by impacting it at a plurality of different directions using one or more ultrasonic indenters made to simultaneously vibrate in the vertical direction and the horizontal direction with said ultrasonic impact treatment of said surface layer providing equiaxial grains in said surface layer, then, (2) subjecting the surface subjected to the ultrasonic impact treatment to heat treatment at 100° to 500° C. for 15 minutes or more to cause precipitation of nanocrystals.

12. A method of production of a steel product with a nanocrystallized surface layer as set forth in claim 11, characterized in that said ultrasonic impact treatment produces an amorphous state in said surface layer.

13. A method of production of a steel product with a nanocrystallized surface layer as set forth in claim 11, characterized in that said ultrasonic impact treatment is accompanied with mechanical alloying.

14. A method of production of a steel product with a nanocrystallized surface layer as set forth in claim 11, characterized by making an amorphous phase and a nanocrystal phase copresent in precipitation of said nanocrystals.

15. A method of production of a steel product with a nanocrystallized surface layer as set forth in claim 11, characterized by shielding the surroundings at the time of said ultrasonic impact treatment from air.

16. A method of production of a steel product with a nanocrystallized surface layer as set forth in claim 11, wherein said ultrasonic impact treatment is by impacting said surface at a plurality of different directions using one indenter made to turn or rock.

17. A method of production of a steel product with a nanocrystallized surface layer as set forth in claim 11, wherein a temperature of the ultrasonic impact treatment is made to be a temperature lower than the recrystallization temperature of the steel.

* * * * *